US005145057A

United States Patent [19]

Hirota et al.

[11] Patent Number: 5,145,057

[45] Date of Patent: Sep. 8, 1992

[54] AUXILIARY CONTACT UNIT FOR AN ELECTROMAGNETIC SWITCH

[75] Inventors: Takato Hirota; Kuniyuki Kogawa; Shigeaki Ohtake, all of Kanagawa, Japan

[73] Assignee: Fuji Electric Corporation, Ltd., Kanagawa, Japan

[21] Appl. No.: 715,887

[22] Filed: Jun. 18, 1991

Related U.S. Application Data

[63] Continuation of Ser. No. 509,767.

[30] Foreign Application Priority Data

Apr. 20. 1989 [JP] Japan ..... 1-46604[U]

[51] Int. Cl.[5] ..... H01H 1/32

[52] U.S. Cl. ..... 200/243; 200/16 A; 200/246; 200/247; 200/250; 200/290; 200/341

[58] Field of Search ..... 200/16 A, 16 C, 243, 200/245, 246, 247, 250, 280, 281, 290, 341, 327

[56] References Cited

U.S. PATENT DOCUMENTS

| | | | |
|---|---|---|---|
| 3,160,730 | 12/1964 | Jakel | 200/250 |
| 3,586,795 | 6/1971 | Mentel et al. | 200/16 A |
| 3,855,558 | 12/1974 | Hayward | 200/280 X |
| 4,262,179 | 4/1981 | Bauer | 200/243 X |
| 4,276,458 | 6/1981 | Alter | 200/16 A X |
| 4,471,178 | 9/1984 | Nishizako et al. . | |
| 4,550,232 | 10/1985 | Lemmer | 200/16 A |
| 4,616,117 | 10/1986 | Kleine | 200/243 |
| 4,634,819 | 1/1987 | Ikeda | 200/16 A |
| 4,650,935 | 3/1987 | Ootsuka et al. | 200/16 A |
| 4,746,779 | 5/1988 | Drexler et al. | 200/248 |

FOREIGN PATENT DOCUMENTS

| | | | |
|---|---|---|---|
| 0074575 | 3/1983 | European Pat. Off. | 200/280 |
| 0340571 | 11/1989 | European Pat. Off. . | |
| 1615903 | 7/1966 | Fed. Rep. of Germany . | |
| 7135631 | 12/1971 | Fed. Rep. of Germany . | |
| 59-42741 | 3/1984 | Japan . | |
| 60-74225 | 4/1985 | Japan . | |
| 366583 | 2/1963 | Switzerland | 200/280 |

OTHER PUBLICATIONS

European Search Report EP 6066-011, dated Oct. 1, 1991.

*Primary Examiner*—Ernest G. Cusick
*Attorney, Agent, or Firm*—Finnegan, Henderson, Farabow, Garrett and Dunner

[57] ABSTRACT

A contact device includes a housing, a fixed contact, and a moving contact attached to a support frame, the support frame and moving contact movable within the housing perpendicular to the fixed contact. A stopping arm projects from the support frame to restrict movement of the support frame within the housing.

11 Claims, 3 Drawing Sheets

AUXILIARY CONTACT UNIT FOR AN ELECTROMAGNETIC SWITCH

This application is a continuation of application Ser. No. 07/509,767, filed Apr. 17, 1990 abandoned.

BACKGROUND OF THE INVENTION

1. Field of the Invention

This invention relates to a contact device and more specifically to a contact device to be attached to an electromagnetic switch for increasing the number of contacts.

2. Description of the Related Art

An electromagnetic contactor, such as an auxiliary relay, usually has auxiliary contacts. Occasionally, more auxiliary contacts are needed due to construction of a controlled circuit. In such a case, a separate contact device is attached to an electromagnetic contactor or an auxiliary relay to increase the number of the auxiliary contacts.

FIG. 3 is a side-elevational view showing a conventional contact device 1 attached to a head portion of a conventional electromagnetic contactor 2. FIG. 4 is a perspective view of the contact device 1 of FIG. 3. FIG. 5 is a perspective view of the electromagnetic contactor 2 of FIG. 3. When the two are to be connected together, frame hook portions 12 formed on a frame 11 of the contact device 1 are inserted in an engaging portion 21 of the electromagnetic contactor 2 to effect the desired connection. At this time, a contact support connector portion 13*a* of the contact device 1 is connected to a contact support 22 of the electromagnetic contactor 2. Through the operation of the contact support 22 of the electromagnetic contactor 2, a contact support 13 of the contact device 1 is driven (upward and downward in the drawings) to thereby open and close a contact (not shown). A conventional a-contact is shown in FIG. 6. In FIG. 6, fixed a-contacts 14*a* are mounted within a frame 11. A conventional b-contact is shown in FIG. 7. In FIG. 7, fixed b-contacts 14*b* are mounted within the frame 11. The movable contact 15*a* (FIG. 6), 15*b* (FIG. 7) is supported on the contact support 13 through a contact spring 16. In the a-contact construction, the movable contact 15*a* is provided in corresponding relation to the fixed contact 14*a*, and in the b-contact construction, the movable contact 15*b* is provided in corresponding relation to the fixed contact 14*b*.

In such conventional contact devices, considering the disengagement of the contact support 13 from the frame 11 when all the contacts are of a b-contact construction as shown in FIG. 7, the movable contact 15*b* is engageable with a distal end 14*b*$_1$ of the U-shaped fixed b-contact 14*b*, which thus serves as a stopper for preventing the contact support 13 from becoming disengaged from the frame 11.

FIG. 8 is a cross-sectional view of a second embodiment of a conventional b-contact construction which differs from that of FIG. 7 in that each fixed b-contact 14*b*′ is of a flat plate-like shape, and that a cover 17 is provided to serve as a stopper for preventing the contact support 13 from being disengaged from the frame 11.

As discussed above, conventional contact devices are shown in FIGS. 6–8. The conventional contact device of a b-contact construction needs a stopper so that a contact support can not be disengaged from a frame. In FIG. 7, a fixed contact has a U-shaped cross-section, and a problem arises from this that since the width H of this U-shape is large, its dimension in a direction of movement of the contact support is large. With respect to the example shown in FIG. 8, since the cover is provided as a stopper, the number of the component parts as well as the time required for assembly is increased, resulting in increased costs.

It is an object of the present invention to provide a contact device which does not increase the dimension of a stopper, provided for preventing the disengagement of a contact support, in a direction of movement of the contact support, and also does not cause increased costs.

SUMMARY OF THE INVENTION

According to the present invention, the above object has been achieved by a contact device comprising fixed contacts fixed to a frame, a contact support mounted within said frame and being movable in its axial direction, and a movable contact mounted on said contact support through a contact spring, the contacts being opened and closed by the axial movement of said contact support, wherein a projecting piece is formed on an inner end of said contact support and projects from the opposite sides of said inner end; and the distance between the opposite ends of said projecting piece is greater than the distance between said fixed contacts.

In this construction, the projection piece is formed on the inner end of the contact support, and therefore even in the case where the movable contact is arranged outwardly (the right side as shown in the drawings) of the fixed contacts, when the contact support supporting the movable contact is moved, the projecting piece formed on the inner end of the contact support is abutted against the rear surface of the fixed contacts, so that the contact support will not be disengaged from the frame. The projecting piece can be very thin, and therefore the dimension in the direction of movement of the contact is not increased.

Additional objects and advantages of the invention will be set forth in the description which follows, and in part will be obvious from the description, or may be learned by practice of the invention. The objects and advantages of the invention may be realized and obtained by means of the instrumentalities and combinations pointed out in the claims.

DESCRIPTION OF THE PREFERRED EMBODIMENTS

Figure 1:
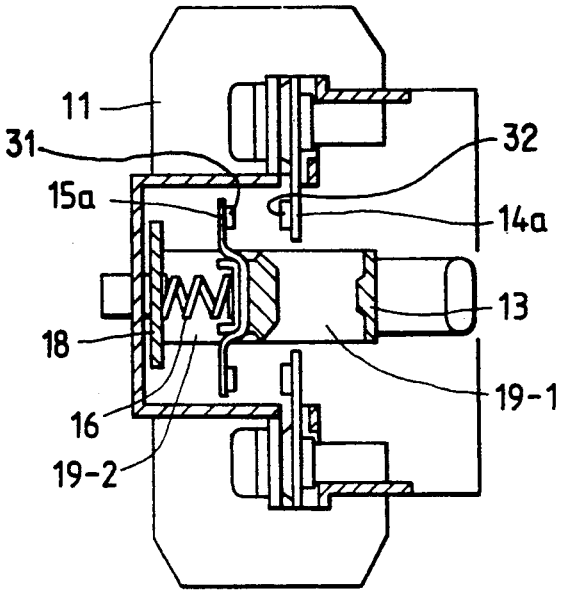
FIG. 1 is a cross-sectional view of an a-contact device according to the present invention.
Figure 2:
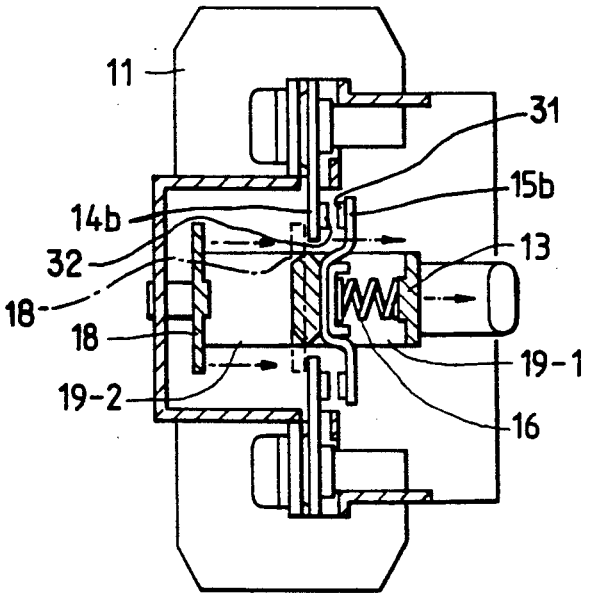
FIG. 2 is a cross-sectional view of a b-contact device according to the present invention.
Figure 3:
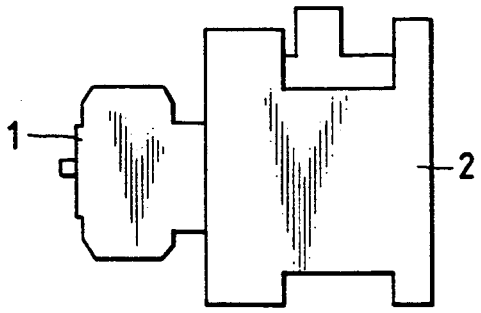
FIG. 3 is a side-elevational view, showing a contact device attached to an electromagnetic contactor in an overhung manner.
Figure 4:
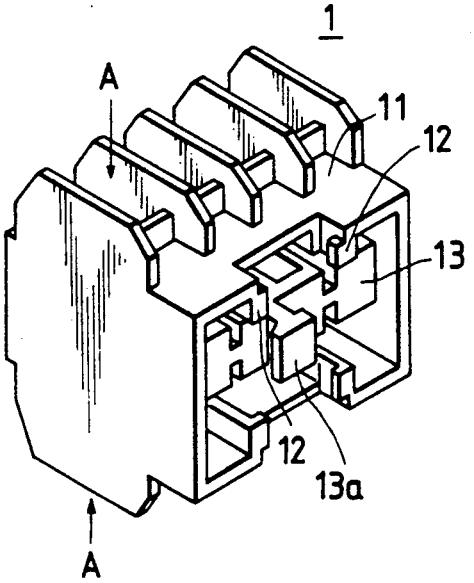
FIG. 4 is a perspective view of the contact device of FIG. 3.
Figure 5:
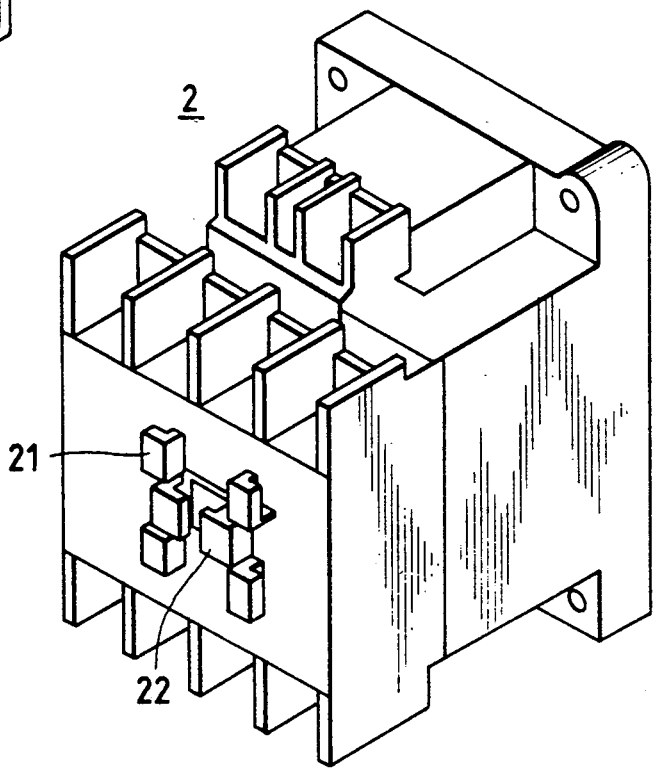
FIG. 5 is a perspective view of the electromagnetic contactor of FIG. 3.
Figure 6:
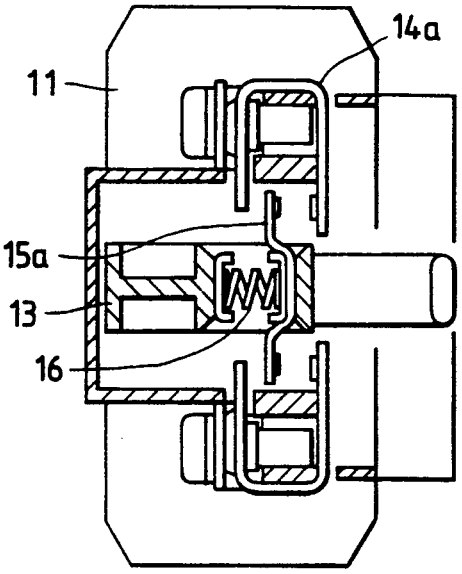
FIG. 6 PRIOR ART
FIG. 6 is a cross-sectional view of a conventional a-contact device.
Figure 7:
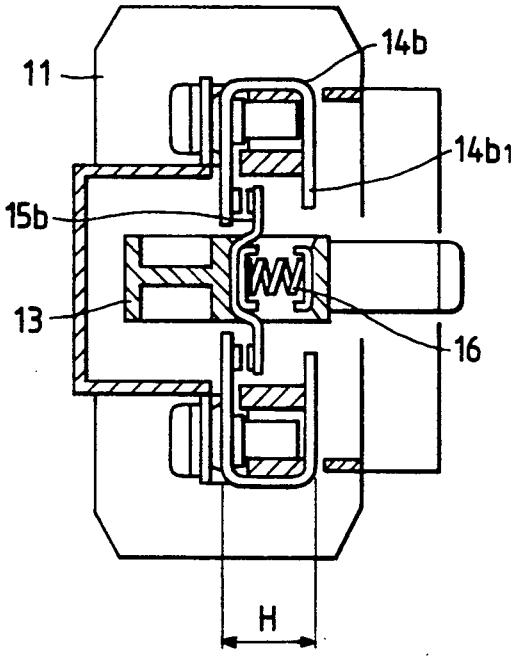
FIG. 7 PRIOR ART
FIG. 7 is a cross-sectional view of a conventional contact device.
Figure 8:
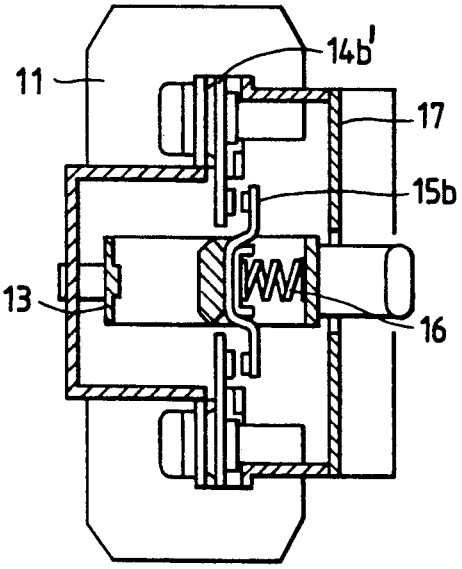
FIG. 8 PRIOR ART
FIG. 8 is a cross-sectional view of yet another conventional b-contact device.

FIGS. 1 and 2 show preferred embodiments of the present invention. FIG. 1 is a cross-sectional view of an a-contact device. FIG. 2 is a cross-sectional view of a b-contact device. Referring to FIGS. 1 and 2, fixed contacts attached to a frame 11 have a flat plate-like shape. In an a-contact device, there are provided fixed a-contacts 14*a*. In a b-contact device, there are provided fixed b-contacts 14*b*. Each of movable contacts 15*a* and 15*b* is supported on a contact support 13 through a contact spring 16, and is provided at contact support windows 19-1 and 19-2, respectively.

In the a-contact device shown in FIG. 1, the movable contact 15*a* including contact element 31 is disposed inwardly (the left side as shown in FIG. 1) of the fixed a-contact 14*a* including contact element 32. Therefore, when the contact support 13 moves in a right-hand direction, the movable contact 15*a* is brought into contact with the fixed a-contact 14*a* with contact element 31 in contact with contact element 32, so that the contact support 13 will not become disengaged from the frame 11.

In the b-contact device shown in FIG. 2, the movable contact 15*b* including contact element 31 is disposed outwardly (the right side as shown in FIG. 1) of the fixed b-contact 14*b* including contact element 32. Therefore, when the contact support 13 is moved in a right-hand direction, the contact support 13 will tend to disengage from the frame 11. However, a projecting piece 18 formed on an inner end of the contact support 13 abuts against the rear surfaces of the fixed b-contacts 14*b*, thereby preventing the disengagement.

According to the present invention, the projecting piece is formed on the inner end of the contact support, and therefore the projecting piece performs the function of a stopper so that the contact support will not be disengaged from the frame. Further, there is no need to increase the number of the component parts and also no need to bend the fixed contact into a U-shaped cross-section, and therefore the cost of the material of the fixed contact is reduced to thus achieve a cost reduction. Further, since the fixed contact has a flat plate-like shape, its dimension in the direction of movement of the contact support is decreased, and an inexpensive, small-size contact device can be achieved.

Additional advantages and modifications will readily occur to the skilled in the art. The invention in its broader aspects is, therefore, not limited to the specific details shown and described. Accordingly, departures may be made from such details without departing from the scope of the applicant's invention.

What is claimed is:

1. A contact assembly, comprising:

frame means for housing the contact assembly;

a first contact, including a first contact element, said first contact fixedly depending from said frame means in a first direction;

a second contact including a second contact element, said second contact being alternately movable within said frame means in an engaging direction, perpendicular to said first direction so as to bring said second contact element into engaged relationship with said first contact element, and a disengaging direction perpendicular to said first direction so as to bring said second contact element out of engaged relationship with said first contact element;

supporting means for supporting said second contact and movable with said second contact within said frame means alternately in said engaging and disengaging directions; and a projecting portion extending from said supporting means in the first direction spaced from said second contact and movable with said second contact and supporting means, for stopping movement of said second contact and supporting means in the disengaging direction.

2. The contact assembly of claim 1, wherein said second contact is located on said supporting means so that said first contact extends between said second contact and said projecting portion, and said projecting portion stops movement of said support means in the disengaging direction.

3. The contact assembly of claim 1, further including means for urging said second contact into engagement with said first contact.

4. The contact assembly of claim 3, wherein said urging means includes a spring connecting said second contact and said supporting means.

5. An auxiliary contact assembly attachable to an electromagnetic switch, comprising:

frame means, attachable at selected times to the electromagnetic switch, for housing the auxiliary contact assembly;

a first contact including a first contact element, said first contact fixedly depending from said frame means in a first direction and electrically connected to the electromagnetic switch at the selected times;

a second contact including a second contact element, said second contact being alternately movable within said frame means in an engaging direction, perpendicular to said first direction so as to bring said second contact element into engaged relationship with said first contact element, and a disengaging direction so as to bring said second contact element out of engaged relationship with said first contact element;

supporting means for supporting said second contact and movable with said second contact within said frame means alternately in said engaging and disengaging directions; and a projecting portion extending from said supporting means in the first direction spaced from said second contact and movable with said second contact and supporting means, for stopping movement of said second contact and supporting means in the disengaging direction.

6. A contact assembly comprising:

frame means for housing the contact assembly, having a closed end and an opposing open end defining a first direction between said open and closed ends;

a first contact including a first contact element adjacent a distal end thereof, said first contact fixedly depending from said frame means intermediate said closed and open ends in a second direction generally perpendicular to said first direction;

a second contact including a second contact element, said second contact being movable within said frame means in said first direction, alternately toward said open end and said closed end in order to alternately make and break contact between said first and second contact elements;

supporting means for supporting said second contact and movable with said second contact within said frame means alternately toward said open end and said closed end, defining a first distance in said second direction between said supporting means and said distal end of said first contact; and a projecting portion extending from said supporting means in the second direction, spaced from said second contact and movable with said second contact and supporting means, said projecting portion extending a second distance greater than said first distance between said supporting means and said distal end of said first contact.

7. The contact assembly of claim 6, wherein said second contact is located on said supporting means between said projecting portion and said first contact, and said second contact element engages said first contact element to stop movement of said support means and second contact in the first direction toward said open end.

8. The contact assembly of claim 6, wherein said second contact is located on said supporting means so that said first contact extends between said second contact and said projecting portion, and said projecting portion engages said distal end of said first contact to stop movement of said support means and second contact in the first direction toward said open end.

9. The contact assembly of claim 6, further including means for urging said second contact into engagement with said first contact.

10. The contact assembly of claim 9, wherein said urging means includes a spring connecting said second contact and said supporting means.

11. An auxiliary contact assembly attachable to an electromagnetic switch, comprising:

frame means, attachable at selected times to the electromagnetic switch, having a closed end and an opposing open end defining a first direction between said open and closed ends, for housing the auxiliary contact assembly;

a first contact including a first contact element adjacent a distal end thereof, said first contact fixedly depending from said frame means intermediate said closed and open ends in a second direction generally perpendicular to said first direction;

a second contact including a second contact element, said second contact being movable within said frame means in said first direction, alternately toward said open end and said closed end in order to alternately make and break contact between said first and second contact elements;

supporting means for supporting said second contact and movable with said second contact within said frame means alternately toward said open end and said closed end, defining a first distance in said second direction between said supporting means and said distal end of said first contact; and a projecting portion extending from said supporting means in the second direction, spaced from said second contact and movable with said second contact and supporting means, said projecting portion extending a second distance greater than said first distance between said supporting means and said distal end of said first contact.

* * * * *

UNITED STATES PATENT AND TRADEMARK OFFICE

CERTIFICATE OF CORRECTION

PATENT NO. : 5,145,057
DATED : September 8, 1992
INVENTOR(S) : Takato Hirota, et. al.

It is certified that error appears in the above-indentified patent and that said Letters Patent is hereby corrected as shown below:

On the Title page, item [63], under Related U.S. Application Data, after "509,767" insert -- Apr. 17, 1990, abandoned--.

Signed and Sealed this

Eleventh Day of January, 1994

Bruce Lehman

*Attest:*

BRUCE LEHMAN

*Attesting Officer*

*Commissioner of Patents and Trademarks*